US007012187B2

(12) United States Patent
Aldridge

(10) Patent No.: US 7,012,187 B2
(45) Date of Patent: Mar. 14, 2006

(54) PROXIMITY DETECTION SYSTEM AND METHOD

(76) Inventor: Raymond Daniel Wilson Aldridge, 819 17th Ave., Menlo Park, CA (US) 94025

( * ) Notice: Subject to any disclaimer, the term of this patent is extended or adjusted under 35 U.S.C. 154(b) by 0 days.

(21) Appl. No.: 11/071,023

(22) Filed: Mar. 2, 2005

(65) Prior Publication Data

US 2005/0172791 A1 Aug. 11, 2005

Related U.S. Application Data

(60) Continuation of application No. 10/746,204, filed on Dec. 23, 2003, now Pat. No. 6,878,870, which is a division of application No. 09/872,988, filed on May 31, 2001, now Pat. No. 6,700,051.

(60) Provisional application No. 60/235,474, filed on Sep. 26, 2000.

(51) Int. Cl.
*G10H 3/14* (2006.01)

(52) U.S. Cl. ..... 84/733; 324/658

(58) Field of Classification Search ..... 324/658; 84/723–746
See application file for complete search history.

(56) References Cited

U.S. PATENT DOCUMENTS

| | | | | |
|---|---|---|---|---|
| 4,555,954 | A | 12/1985 | Kim | |
| 4,761,005 | A | 8/1988 | French | |
| 4,852,443 | A | 8/1989 | Duncan et al. | |
| 4,974,833 | A | 12/1990 | Hartman | |
| 4,986,136 | A | 1/1991 | Brunner et al. | |
| 5,184,831 | A | 2/1993 | Garner | |
| 5,463,388 | A | 10/1995 | Boie et al. | |
| 5,964,683 | A | 10/1999 | Norblom | |
| 6,429,367 | B1 | 8/2002 | Fishman | |
| 6,700,051 | B1 * | 3/2004 | Aldridge | 84/733 |
| 6,878,870 | B1 * | 4/2005 | Aldridge | 84/733 |

* cited by examiner

*Primary Examiner*—Jeffrey W Donels
(74) *Attorney, Agent, or Firm*—Squire, Sanders & Dempsey

(57) ABSTRACT

A system electronically detects and registers contact, especially in contact sport embodiments. An example contacting instrument includes a switch, a tone generator and a conductive mesh. An example detecting instrument includes a conductive mesh and a tone decoder. In a contact sport embodiment, each combatant possesses, for example, as part of the combatant's respective uniform, one or more contacting instruments and one or more detecting instruments embedded in prescribed contact zones. The basic goal of a combatant is to strike a contact zone of their opponent with one of their contacting instruments. The detecting instrument will recognize the tone, thereby recognizing a hit.

38 Claims, 14 Drawing Sheets

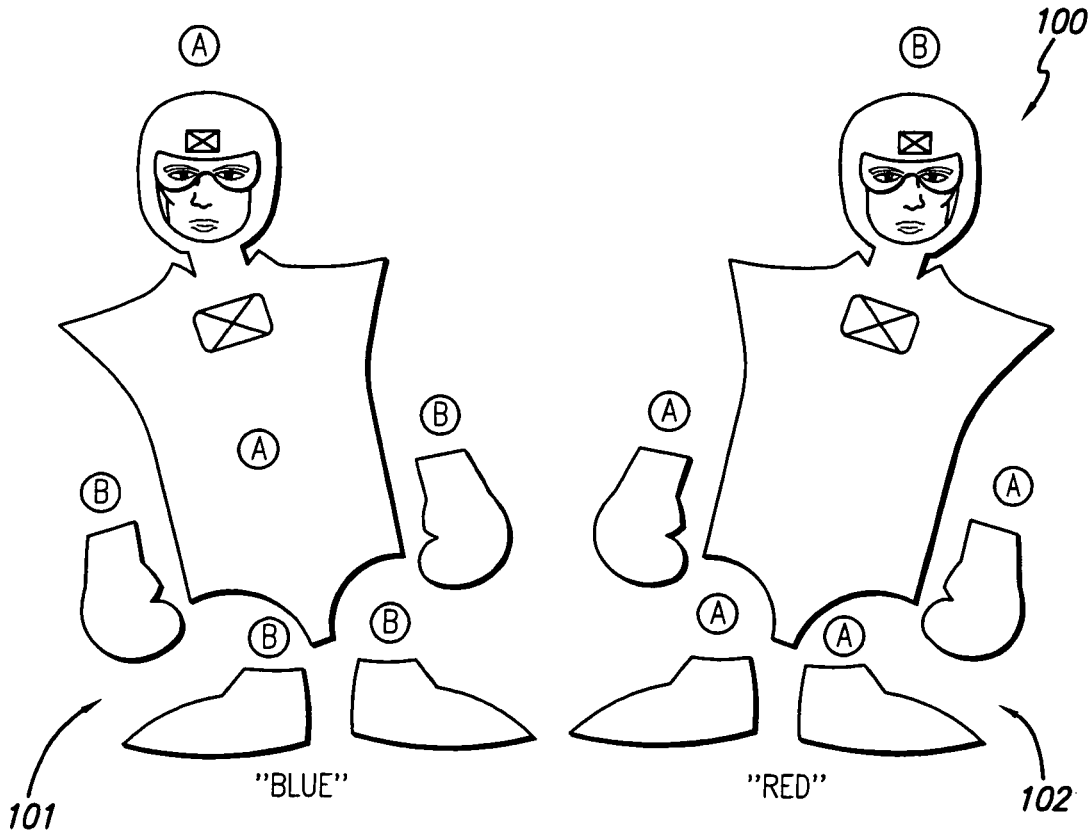
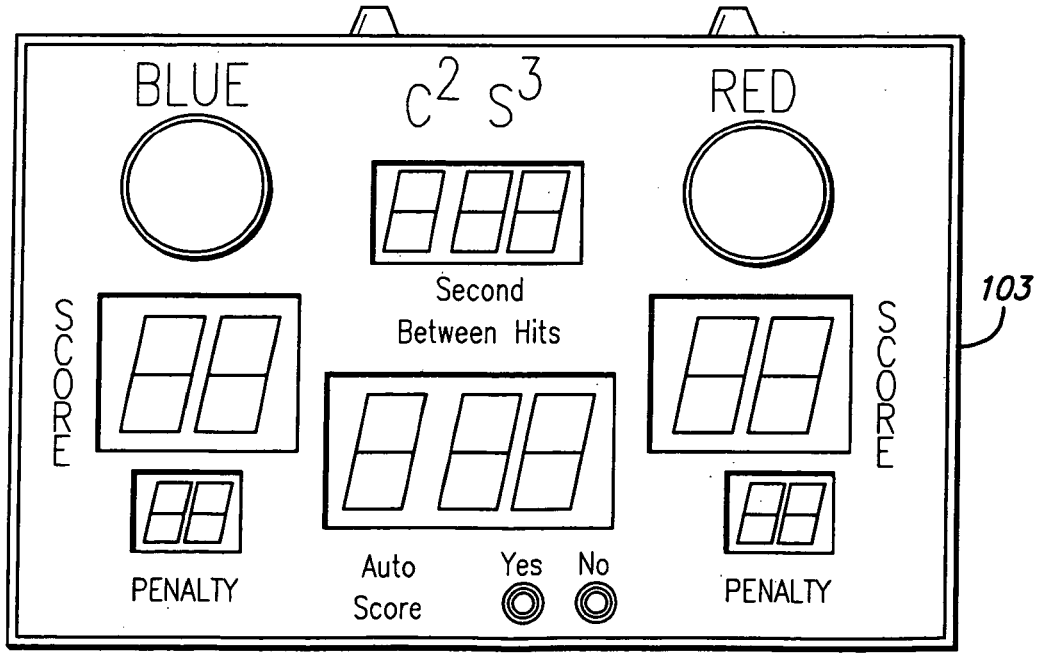
FIG. 1

| TABLE OF RF CHANNEL ASSIGNMENTS FOR OPPONENT "A" [RF FREQ.=L] | | | | |
|---|---|---|---|---|
| IMPULSE TONES | VEST (A) | HEAD (B) | GROIN (C) | RF CHANNEL |
| A AND X (D) | X | | | 1 |
| A AND Y (E) | X | | | 2 |
| A AND Z (F) | X | | | 3 |
| A AND X (D) | | X | | 4 |
| A AND Y (E) | | X | | 5 |
| A AND Z (F) | | X | | 6 |
| A AND X (D) | | | X | 7 |
| A AND Y (E) | | | X | 8 |
| A AND Z (F) | | | X | 9 |
| A AND X (D) | X | X | | 10 |
| A AND Y (E) | X | X | | 11 |
| A AND Z (F) | X | X | | 12 |
| A AND X (D) | X | | X | 13 |
| A AND Y (E) | X | | X | 14 |
| A AND Z (F) | X | | X | 15 |
| A AND X,Y, OR Z | X | X | X | 16 |
| | | | | |

TONES A AND X ARE PRODUCED BY A SOFT IMPULSE SWITCH ACTIVATION

TONES A AND Y ARE PRODUCED BY A MEDIUM IMPULSE SWITCH ACTIVATION

TONES A AND Z ARE PRODUCED BY A HARD IMPULSE SWITCH ACTIVATION

| | | |
|---|---|---|
| RIGHT HAND TONES | FUTURE CAPABILITY (TONE A1 AND X, Y, OR Z) | 1–16 |
| LEFT HAND TONES | FUTURE CAPABILITY (TONE A2 AND X, Y, OR Z) | 17–32 |
| RIGHT FOOT TONES | FUTURE CAPABILITY (TONE A3 AND X, Y, OR Z) | 33–48 |
| LEFT FOOT TONES | FUTURE CAPABILITY (TONE A4 AND X, Y, OR Z) | 49–64 |
| | | |

NOTE 1: THE (A–F) IN THE ABOVE TABLE ARE MICROCONTROLLER INPUTS SEE FIG12
NOTE 2: FOR OPPONENT B ALL TONE "A" REFERENCES WOULD BE REPLACE BY TONE "B" AND A RF FREQ.= M.
NOTE 3: MULTIPLE PAIRS OF RF FREQUENCIES ARE CHOSEN FOR EACH SCOREBOARD TRANSMITTER / RECEIVER PAIR TO AVOID INTERFERENCE WHEN MANY MATCHES ARE UNDERWAY IN CLOSE PROXIMITY. AT PRESENT 32 RF FREQUENCIES ARE PLANED.

FIG. 13

PROXIMITY DETECTION SYSTEM AND METHOD

PRIORITY REFERENCE TO PRIOR APPLICATIONS

This application is a continuation, claims benefit of and incorporates by reference U.S. patent application Ser. No. 10/746,204 entitled "Contact Detection System and Method," filed Dec. 23, 2003 now U.S. Pat. No. 6,878,870, which is a divisional of, claims benefit of and incorporates by reference patent application Ser. No. 09/872,988, entitled "Contact Detection System and Method," filed on May 31, 2001 now U.S. Pat. No. 6,700,051 by inventor Raymond Aldridge, which claims benefit of and incorporates by reference patent application Ser. No. 60/235,474, entitled "Karate Tournament System and Method," filed on Sep. 26, 2000, by inventors Raymond Aldridge and Ronald Pohnel.

BACKGROUND OF THE INVENTION

1. Field of the Invention

The present invention relates to contact detection and to contact sports.

2. Background Art

Karate, kung-fu, tae-kwondo, kick-boxing, boxing, fencing, paint-ball and other contact sports enjoy increasing popularity as physical sports and mental disciplines. Many of these contact sports are present day successors to ancient forms of hand-to-hand combat practiced in various regions of Asia. Today, the competitive aspects of these contact sports are generally practiced by combatants in a ring (with or without ropes on the perimeter) similar to the type used in boxing.

These contact sports employ, in training and competition, full-contact formats, non-contact formats or light-contact (controlled) formats, with opponents of approximately equal experience and weight. Training must be done on a regular basis to effectively develop the skills to defend oneself in life-threatening situations or to perform optimally in organized competition. In the non-contact or light-contact formats of sparring practice, martial arts such as karate, kung-fu, etc., differ from professional boxing. In martial arts practice, offensive "techniques" or attack moves are delivered to an opponent's body with full power and speed. They are, however, ideally controlled, pulled or stopped just short of actual physical contact or upon only light contact, depending on applicable rules of competition. This restraint is not only employed because of the great potential for serious injury that can result from skillfully delivered, unrestrained martial arts technique, but also because precise control demonstrates mental discipline and physical prowess.

A point may be awarded to a combatant when an unblocked attack or technique is delivered to the region of a designated legal target or "vital" area of the opponent's body, with sufficient speed, power and form to be adjudged to potentially cause damage to the opponent's body if otherwise not controlled. Vital areas include the kidneys, solar plexus, face and groin. An added requirement is that a point will be awarded only when a technique threatens a designated vital or target area with impact by a predetermined "designated hitting surface" of the attacking fighter's body. Designated hitting surface areas include, for example, the first two knuckles of a closed fist, the side of the hand, and the ball of the foot. Excessive contact in delivering a technique in non-contact or light-contact matches can cause a fighter to be disqualified or to be denied points.

A problem created by non-contact or light-contact sports, such as these controlled martial arts sparring exercises, is that accurate scoring is predicated on the subjective evaluation of an exchange of techniques between combatants, either by the combatants themselves, or by as many as five experienced judges, strategically positioned in tournament matches at corners of the ring and within the ring itself. Dependence on this subjective judgment sometimes results in improperly awarded points, missed points, excessive contact (by a participant attempting to forcefully "record" his point unmistakably for the judges) and in second punching by the defending fighter because he ignored, by design or accident, his opponent's scoring technique. Martial arts combatants can maneuver their bodies and deliver attacks to their opponents with extreme speed and flurries of action. The speed amplifies the difficulty in determining when points should be scored. Even where several officials are employed to judge a match, visual identification of scoring maneuvers is difficult. Disagreement between officials often occurs, due to inequality of perspective enjoyed by the various officials. Moreover, visual acuity vary among officials, and even, over time, in the same official.

Participants in the contact sports of professional boxing, professional karate and kickboxing deliver their techniques with full power and speed in competitive matches with the goal of rendering their opponent temporarily incapacitated. A scoring system based on the visible accumulation of damaging blows represents one mode of measuring the effectiveness of a fighter's technique. The rigorous nature of such contests limits participation, and offers potential for significant injury to the combatants. Full-contact matches that end without a knockout or TKO and non-contact and light contact matches are bound by subjective scoring.

Increasing number of martial arts practitioners wear protective garments including padding that cover the fighters' designated hitting areas, such as the hands and feet. Such protective wear protects a fighter from accidental contact and severe injury. Use of protective wear is typically mandated in the great majority of tournaments in the United States and Canada. Several scoring systems have been developed to be used in conjunction with protective padding. Most of these systems employ some form of pressure-sensitive contact surface to register a blow. The major problems with these systems include their susceptibility to false hits from self-activation and lack of a simple and dependable "force of contact" detection mechanism. Therefore, a simple, cost-effective and dependable contact-detection system and method and an accurate scoring system and method are needed.

SUMMARY

The present invention provides systems and methods for enabling more dependable contact detection and, in contact sport embodiments, scoring. One embodiment described herein is a full-contact martial arts sports scoring system tailored for karate. With slight modifications, other embodiments could be easily tailored for other contact sports such as kickboxing, kung fu, boxing, paint-ball, projectiles, and fencing. Further, other embodiments could be tailored for use in non-sport related contact detection. For example, lights in a building may turn on and off based on contact detection. Children's clothing may include contact detection mechanisms to recognize misbehavior. A preschool toy embodiment may not require one player to hit the other player to score. Instead, this toy might allow players to compete against each other by being the first to hit target areas of a floor mat with a bat or some similar striking instrument. The target area would either be identified via voice, (e.g., "hit the red square" or "what is 2+2") or via a visual identifier such as a flashing light on the mat in the active target area. The mat would uniquely detect each player striking instruments. The system could be set up to keep the score and determine a winner or just make different sounds for the first player to hit the active floor area. This system could also be used for a single player play. Another toy similar to the preschool toy may have a more aggressive game play concept. For example, the target may move, may be difficult to ascertain, or may be randomly active for a short periods of time.

A contacting instrument such as a glove, shoe, foil or ball includes a tone generating circuit, and a detecting instrument (or contact zone) such as a vest, or helmet includes a tone-detecting circuit. The tone generating and detecting circuits can utilize either a multi-tone or a pulse train of a single tone. While both tone alternatives have been demonstrated to be effective, using a multi-tone format has proven to be simpler and faster. The following discussion focuses on multi-tone format although the pulsed single tone method is an effective alternative.

Each contacting instrument contains a series of multi-tone-generating electronic circuits. Each detecting instrument is connected to an electronic circuit capable of uniquely detecting the tones generated by the contacting instrument. In this embodiment, the occurrence of a successfully detected multi-tone signal in the contact zone is transmitted to a remote scoreboard via a radio frequency transmitter. Depending upon the configuration within the scoreboard, the score of the aggressing combatant can be either automatically or manually advanced. For simplicity of explanation, the opponents will be identified as combatant BLUE and combatant RED. A simple scenario of scoring by combatant BLUE follows:

1) The contacting instrument of combatant BLUE, that is equipped with a multi-tone generator, is thrust, swung, or shot at combatant RED;
2) Upon sufficiently forceful contact of combatant BLUE's contacting instrument onto some object, an impulse switch is closed in combatant BLUE's contacting instrument, thereby triggering the contacting instrument's battery-powered tone-generating circuit;
3) If the object which combatant BLUE struck was one of the tone-detecting contact zones of combatant RED, the generated tone is transferred to and detected by combatant RED's battery-powered tone-detecting circuit via capacitive, inductive, or physical coupling (capacitive coupling being the technique detailed herein, while inductive and physical coupling have been demonstrated, as well, and are acceptable alternatives);
4) Upon successful tone detection by the detecting instrument, an RF transmitter is triggered for a short duration;
5) This signal is received in the scoreboard via a matched RF receiver (each combatant's transmitter would possess a unique RF carrier frequency);
6) The software in the scoreboard can be configured to automatically score a point for combatant BLUE or signal a judge of the contact prompting the judge to increment combatant BLUE's score if, in the judge's opinion, the score is deemed valid; and
7) The system software can distinguish between two near simultaneous contacts (A to B and B to A) within $1/100^{th}$ of a second.

In item 2 of the above scenario, it is appreciated by one of ordinary skill in the art that other switch types such as pressure sensitive switches, piezoelectric switches, or capacitive switches may be used as alternatives to the impulse switch.

A slightly different embodiment would be based on a player striking contact zones attached to something other then the opponents uniform. This embodiment would be utilized for a test apparatus for the purpose of testing the equipment prior to a match. In this configuration, the contact zones would be connected to tone-detecting circuits that would uniquely identify either opponent's forceful contact. This facilitates a single apparatus used to test both competitors. This configuration could also be embodied in a game where opponents would compete to be the first to hit a prescribed contact zone, e.g., a moving target, with their respective contacting instruments.

BRIEF DESCRIPTION OF THE FIGURES

FIG. 1 illustrates a karate scoring system.

FIG. 13 is a table illustrating example RF channel assignments for the transmitter/receiver pair used by the scoreboard to determine the contact force and contact zone.

DETAILED DESCRIPTION

FIG. 1 shows a karate scoring system 100 comprising a scoreboard 103 and two opposing combatants, combatant 101 sporting a "blue" uniform and the other combatant 102 sporting a red uniform. The small circles with the letters "A" or "B" inside indicate the tone-generating frequency and its corresponding tone-detecting frequency. For example, the gloves and the boots of combatant 101 are labeled "B" and the vest and the headgear of combatant 102 are labeled "B." This labeling indicates that the tone generated in the B-labeled gloves and boots are only detectable by the vest and headgear labeled "B" but not detectable by the vest and headgear labeled "A." Similarly, the tone generated in the A-labeled gloves and boots are only detectable by the vest and headgear labeled "A" but not detectable by those labeled "B." This configuration eliminates the problem of self-activation plaguing the pressure sensitive designs. The scoreboard 103 is, in this embodiment, a software-controlled system that can be configured to react in various ways when a valid contact is registered. A more detailed, description of different scoreboard designs and software behavior is detailed in FIGS. 14*a–c* and 15.

Figure 2:
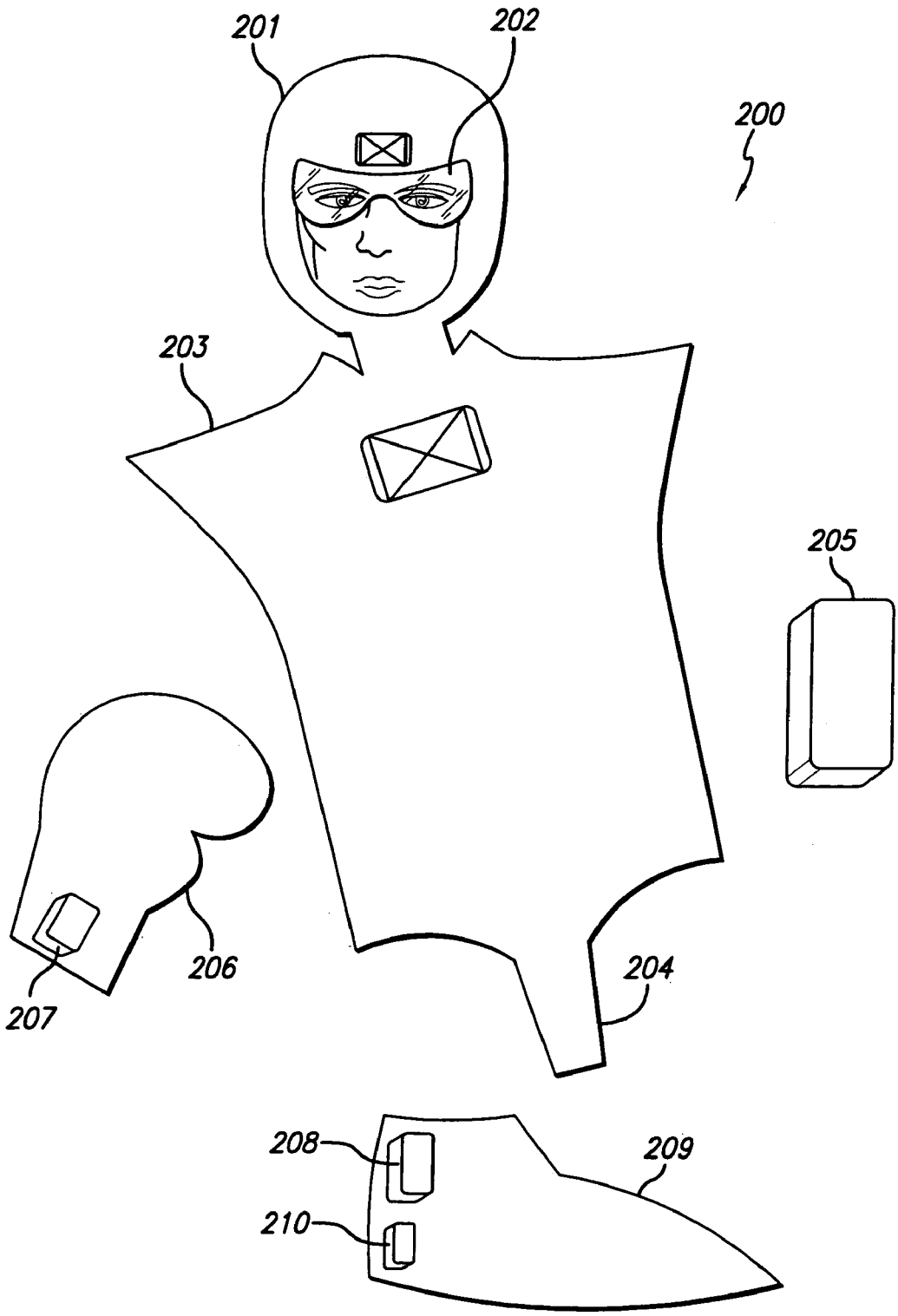
FIG. 2 is a more detailed view of sensor-equipped fighting gear.

FIG. 2 is a detailed view of a karate gear 200 for combatant 101. Both combatants 101 and 102 employ similar gear 200. Therefore, only one set of gear 200 is described in detail. Moreover, since the left and right gloves and boots are functionally identical, only one glove and one boot is described in detail. The difference between the uniforms of combatants 101 and 102, besides color, lies only in the signals produced and detected by their respective electronic circuits. Each set of gear 200 includes two gloves 206, two boots 209, one vest 203, one protective helmet 201, protective eye goggles 202, and one groin protector 204. The glove 206 includes a multi-tone-generating circuit 207, and the boot 209 includes a multi-tone-generating circuit 208, which are both described with reference to FIG. 9. Generally, these circuits 207 and 208 may be substantially identical self-contained battery-powered electronic circuits, each producing the same set of tones. Circuits 207 and 208 produce a unique set of tones that trigger the tone-detecting circuitry of combatant 102, but not those of combatant 101.

The boot 209 may include a pulsed tone generating circuit 210. This circuit is part of an "in-bounds" detection system described in further detail in FIG. 17. This "in-bounds" detection system utilizes a mat capable of electrically coupling the pulsed tone from the boot into a pulsed tones detection circuit. Opposing combatants 101 and 102 may have similar circuits 210, tuned to produce different tones. This circuit 210 produces a pulsed tone several times a second. This signal is detected either by an out-of-bound-zone floor mat circuit if the combatant steps out of the ring, or by the in-bounds-zone floor mat circuit if the combatant remains in bounds. In one embodiment, the absence a combatant's tone on the in-bound mat, the presence of a signal in the out-of-bounds mat circuit, and a valid hit delivered to an opponent could indicate that the blow was delivered while the aggressor was airborne. Details of the circuit are included in the discussion of FIGS. 16 and 17.

Although not shown in this figure, the protective headgear 201 contains an electrically insulated conductive mesh electrically connected to tone-detecting circuit of 205. A pair of protective goggles 202 may be connected to the headgear 201 or worn separately. These goggles are custom designed and include a very fine conductive mesh inside the lenses. This mesh may be electrically connected to the headgears' mesh thus forming a single contact zone.

Figure 6:
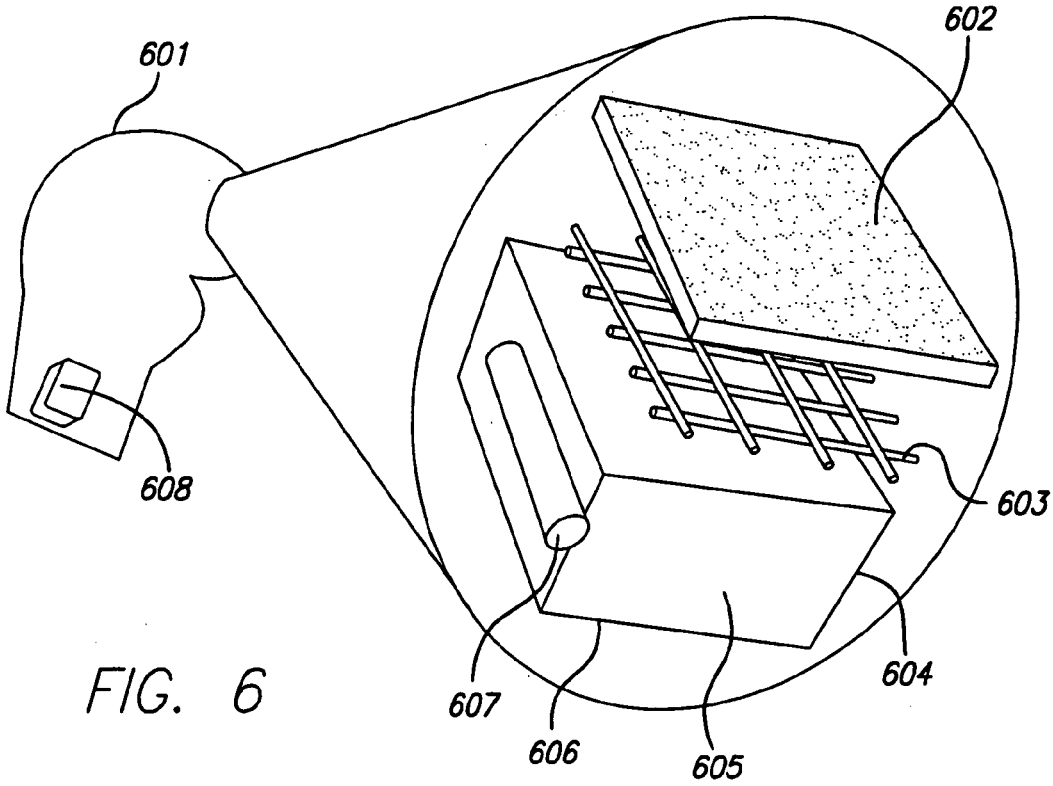
FIG. 6 illustrates details of a contacting instrument.
Figure 10:
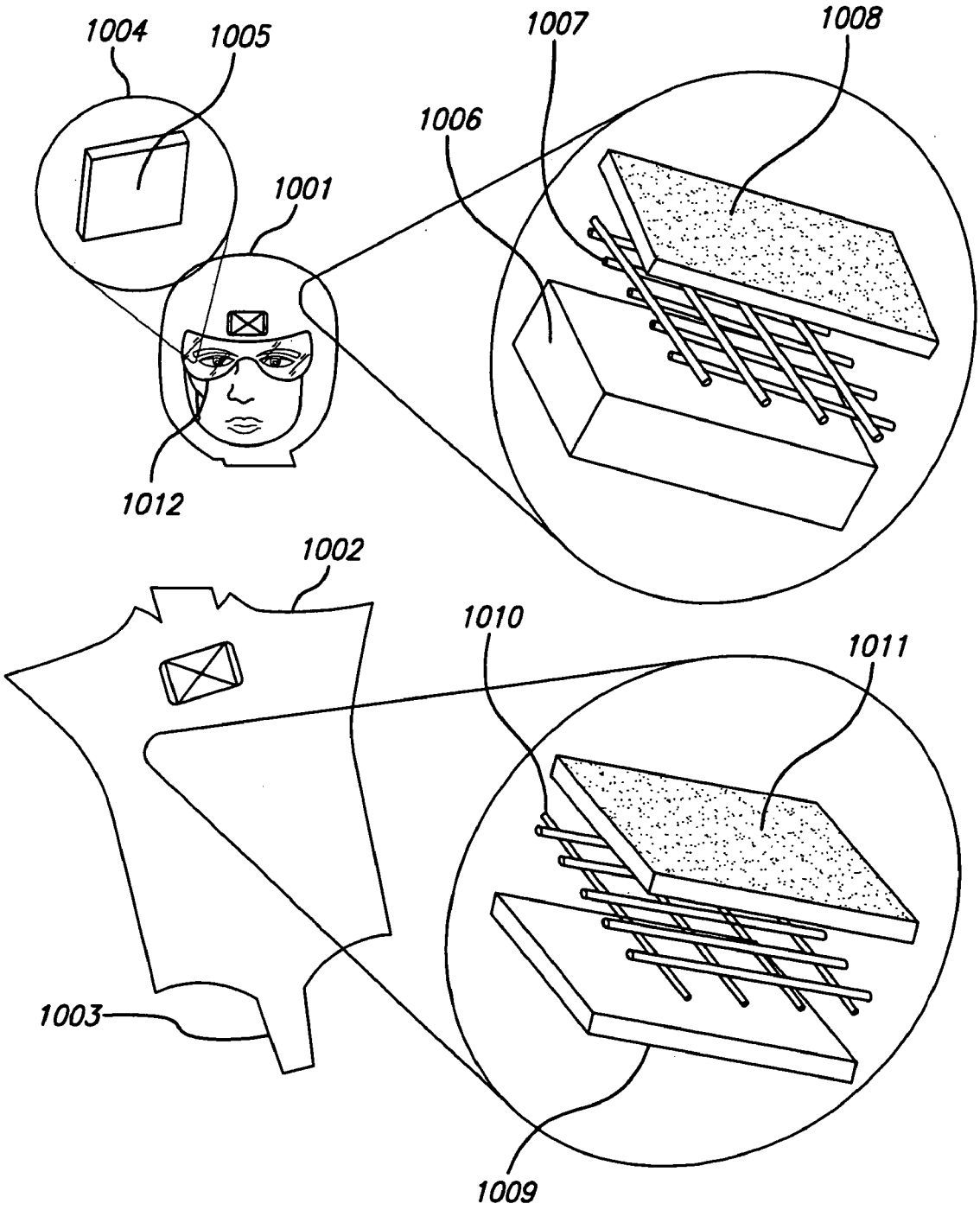
FIG. 10 illustrates a tone-detecting instrument.

The vest 203 and groin cover 204 may be electrically insulated from each other, and are each connected to the tone-detecting circuit 205. The electrical insulation allows each to be an independent contact zone. Since the vest 203 and groin cover 204 are similar in construction, a detailed description will be limited to the vest 203. Like the headgear 201 and goggles 202, the vest 203 and groin cover 204 contain an insulated conductive mesh described in detail below. The construction of the gloves 206 and boots 209 are similar, thus a detailed description will be limited to the gloves. The gloves 206 and boots 209 contain electrically insulated conductive mesh described in detail below. The headgear 201, the goggles 202, the vest 203, the groin cover 204, the gloves 206, and the boots 209 are similar in construction to many commercially available headgears and vests for the full contact sport of karate such as those manufactured by Macho™ or Century™. Details of the headgear 201, the goggles 202, the vest 203, and the groin cover 204 are shown in FIG. 10. Details of the gloves 206 that are the same as the details of the boots 209 are shown in FIG. 6.

The electronic circuit 205 performs four basic functions, namely, the electronic circuit (1) detects the tones generated by the opposing combatant's tone generators 207 and 208; (2) determines which of the three contact zones (head 201 and 202, vest 203, or groin 204) the contact occurred; (3) selects the RF channel the transmitter will transmit based on the tone detected and the zone impacted; and (4) transmits a coded RF signal to the scoreboard 103. It will be appreciated that the RF carrier frequency will be different for each combatant 101 and 102. Details of the electronic circuit 205 are provided in the discussion corresponding to FIG. 12.

Figure 3:
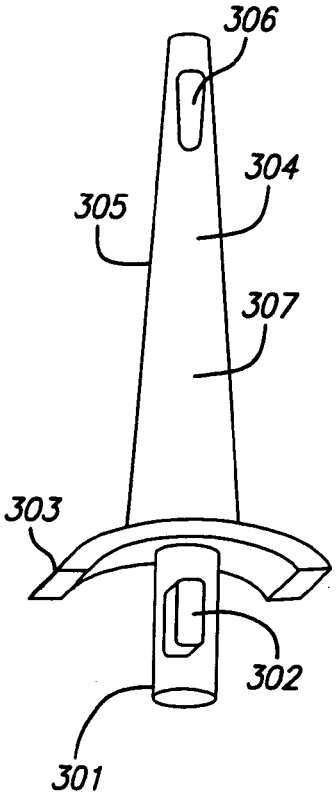
FIGS. 3, 4, and 5 illustrate alternative contacting instruments.

FIG. 3 depicts an alternative contacting instrument 301 similar to a fencing foil that is covered with foam padding 305 and can be used as a child's toy. The instrument 301 includes a hand guard 303, a semi-rigid shaft 304 and a pressure-sensitive switch 306 similar to that used in modern electrically conductive fencing foils. The semi-rigid shaft 304 detects a forceful jab or lunge and turns on the tone generator circuit 302. An impulse switch 307, described below, which in this embodiment is inside the foam padding 305 and located on the rigid shaft 304, detects a forceful side blow and turns on the tone-generating circuit 302. The tone-generating circuit 302 may be disposed inside the handle grip 301 and electrically connected to the conductive, contacting instrument mesh. If the instrument 301 is used for fencing, the tone generator 302 may be electrically connected to the metallic shaft 304 and to the impulse switch 307. The circuit may be triggered by a closure of the pressure switch 306 for a forward thrust or of impulse switch 307 for a side hit. If this closure occurs on a valid contact zone of the opponent's gear 200, similar to that described in FIG. 2, a valid strike will be registered. In the toy embodiment, the tone-detecting vest 203 and headgear 201 and 202 may be more simple. That is, the transmitter may be omitted, and a valid hit could be registered via sounds or lights.

Figure 4:
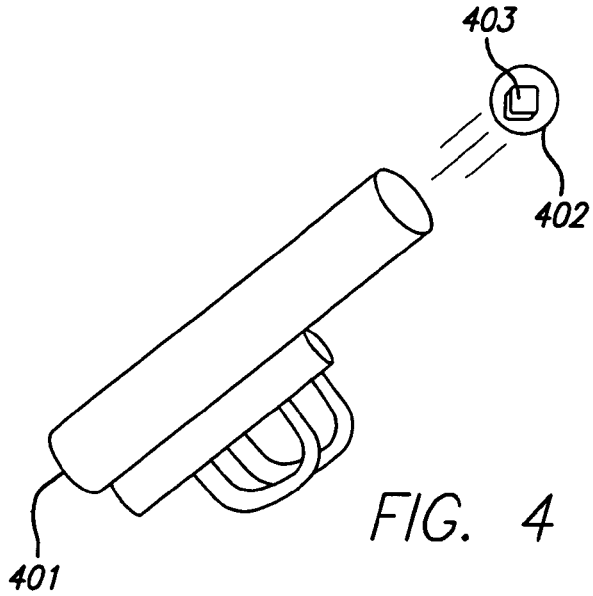

FIG. 4 illustrates a toy gun 401 for shooting a tone-generating projectile 402 with a metallic mesh inside of the padding. The tone-generating electronic circuit 403 is inside the projectile 402. This circuit 403 is triggered via closure of an impulse switch 701 (see FIG. 7) in the projectile when the projectile is launched. The signal stays on for two seconds. If the projectile strikes an opponent's contact zone, a valid strike is registered. This embodiment is similar to the paint ball game (without the mess).

Figure 5:
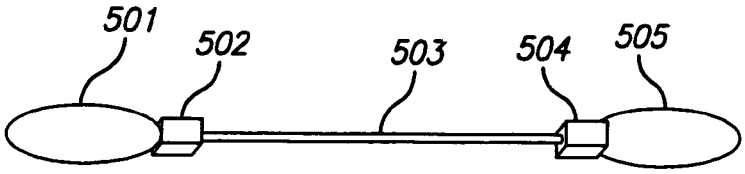

FIG. 5 depicts yet another possible contacting instrument as a stick 500. This stick 500 is a double-ended fighting stick similar to the Pugil-Stick used in the US Army to train soldiers in hand-to-hand combat. Each padded end 501 and 505 includes an insulated metallic mesh electrically connected to the tone-generators circuits 502 and 504. These circuits are triggered via closure of an impulse switch, if one of the contacting instruments 501 or 502 comes into contact with an object. If the aggressor strikes his opponent's contact zone with a sufficiently forceful blow, an impulse switch closes. This closure triggers the tone generators 502 and 504 which will be electrically coupled and detected by aggressor's tone-detecting circuits. The padded contacting instruments 501 and 505 are mounted on a rigid wand portion 503 which is held by the combatant when delivering blows.

FIG. 6 illustrates details of a typical padded contacting instrument, which in the illustrated case is a glove 601. Each contacting instrument 601 contains a padded substrate 604, which, depending upon the sport, includes one or several sets of impulse switches 605, 606, 607 embedded in the key locations. The locations are chosen to maximize the probability that an aggressive blow would result in the closure of one or more of the switches. These switches 605, 606, 607 are electrically connected to the tone-generating circuit 608, which is electrically connected to the insulated conductive mesh 603. Examples of a "conductive mesh" may include a series of insulated or non-insulated electrically connected interwoven conductive wire type material, a single insulated or non-insulated conductive wire type material arranged in any pattern such as zigzags, circles, straight lines, or the like, a solid insulated or non-insulated conductive plate which can be either flexible or rigid, or any electrically connected combination of the above materials or any materials similar to the above identified examples. It is noted that when an insulated "conductive mesh" is used, the protective covering 603 may be functionally omitted although its presence is desirable for protection of the conductive mesh. If direct coupling is employed through completing the circuit, the conductive mesh must be exposed and non-insulated. The three switches 605, 606, 607 may be used to detect three levels of force, namely, soft, medium and hard, of any particular blow. The actual force required to close a particular switch 605, 606 and 607 would be chosen to correspond with a given purpose and weight class. For example, and as a mere illustration, 20 psi may be chosen for a light weight "soft blow" and 30 psi may be chosen for medium weight "medium blow." Each switch 605, 606 and 607 triggers a different set of tone-generating circuits 608. The different tones when detected by the opponent's tone-detecting circuitry coupled with the contact zone information will be used by the RF channel selection circuit to select the correct channel.

Figure 11:
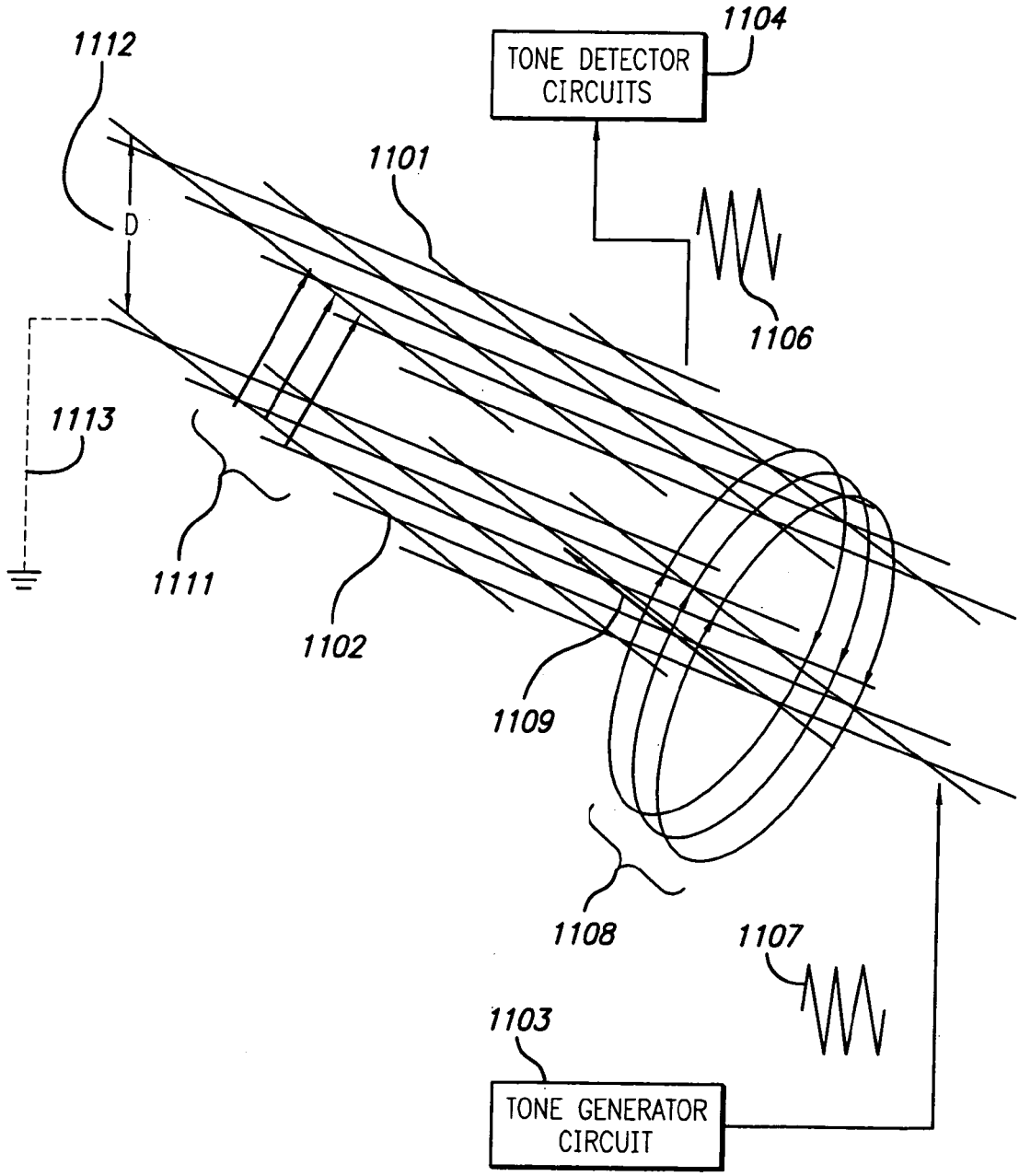
FIG. 11 is a schematic view illustrating the capacitive and inductive coupling employed to couple generated tones.

The purpose of the electrically insulated conductive mesh 603 is to act as one of the plates of a capacitor 1102 (see FIG. 11). When a tone generator circuit 608 produces a tone, the tone becomes electrically present on the mesh 603 and the electric fields fluctuate at the frequencies emitted by the tone generator circuit 608. If the insulated mesh of a contact zone is close enough to the conductive mesh of the contacting instrument (less than, for example, approximately one inch away) for a sufficiently long period of time (for example, approximately 1/10 second), then capacitive coupling and detection of the tone will occur. The external covering 602 protects and assists in the electrical insulating of the conductive mesh 603.

Figure 7:
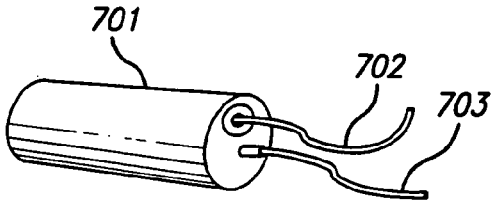
FIG. 7 illustrates an external view of an impulse switch.
Figure 8:
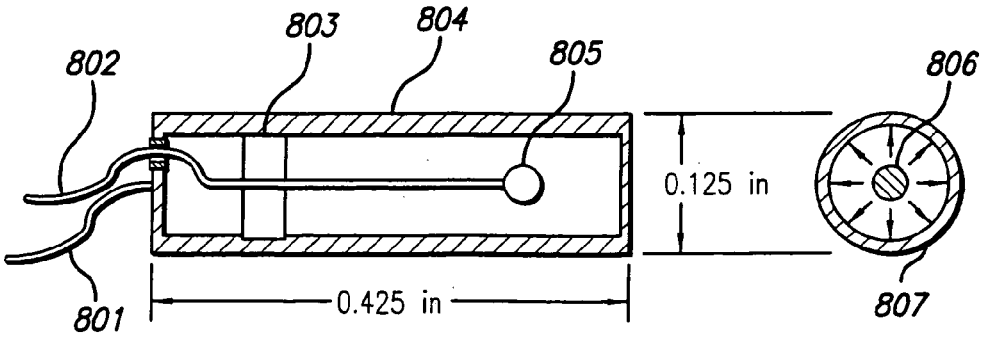
FIG. 8 is a cross-sectional view illustrating details of an impulse switch.

FIG. 7 depicts an external view of an impulse switch 701, and FIG. 8 depicts an internal view. This switch 701 detects selected impulse forces defined as the change in momentum divided by the change in time. FIG. 8 depicts one possible construction of this switch 701. The body of this switch 701 is a metallic can or tube of small diameter. Each switch has two insulated conductors 702 and 703 coupled to the tone-generating circuits shown in FIG. 9. The switch 701 includes impulse-detecting armature 805. This armature 805 is electrically insulated and rigidly held from the switch body 804 by an insulating disk 803. The "stiffness" of this conductive armature 805 is selected to flex the required amount to touch the metallic side of the switch body 804, when the switch 701 is subjected to an impulse force of a defined value or greater.

Figure 9:
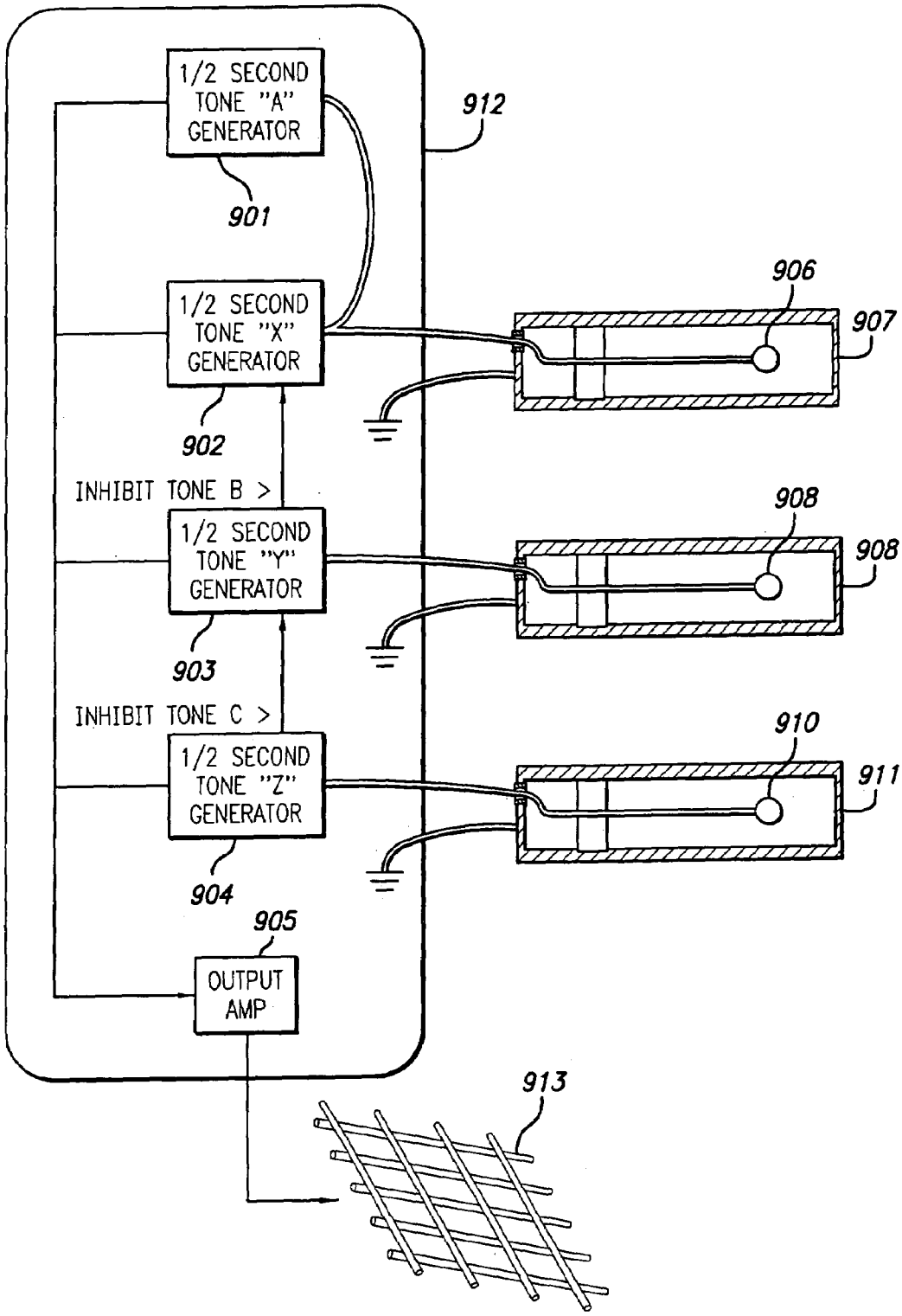
FIG. 9 is a block diagram illustrating the tone-generating circuit of a contacting instrument.

FIG. 9 is a block diagram illustrating a multi-tone-generating circuit 912 of a contacting instrument. Circuit 912 is a simplified view, not showing resistors or capacitors that may be needed for each tone-generating circuit 901, 902, 903, 904. The multi-tone-generating circuit 912 shown is for combatant 101. For combatant 102, the tone-generating circuit 901 produces a tone of frequency B instead of A. As shown in FIG. 9, any signal produced by generator 901, 902, 903, or 904 is amplified and buffered by the output amplifier 905. The tone present on the metallic mesh 913 is one of the tone pairs A&X, A&Y or A&Z. A tone would only be present on metallic mesh 913 if the contacting instrument experiences a sufficient impulse to close an armature 906, 908, 910 within one or more of the impulse switches 907, 909, 911. The armature 906 of impulse switch 907 is selected to detect a soft impulse and, when activated, turns on tone A and tone X. If the impulse force is sufficient, the armature 908 of the medium impulse switch 909 closes, thereby triggering tone Y, maintaining tone A and turning off tone X. If the impulse is of even a greater force, the armature 910 of the hard impulse switch closes, thereby triggering tone Z, maintaining tone A and turning off tone Y. In other embodiments, triggering a tone of a "higher" switch need not turn off the tone of the "lower" switch. The tones could co-exist on the same signal line. The multitone generator 912 can be constructed utilizing a variety of commercially available integrated circuits. An example of one such circuit is the LM555 timer configured as a simple square wave generator. To achieve a multitone generator two or more LM555 would be connected to a common output to the metallic mesh on the contacting instrument 913.

FIG. 10 illustrates details of a detecting instrument, e.g., the protective helmet 1001, vest 1002, groin cover 1003, or goggles 1012. Each detecting instrument 1001, 1002, 1003 contains a conductive mesh 1007, 1010, which is completely electrically isolated and insulated. If a conductive path becomes available for the potential present on the mesh, the magnitude of the electrical field can be greatly reduced to the point where no capacitive coupling can no longer occur.

The purpose of the electrically isolated conductive mesh 1007, 1010 is to act as one of the plates of a capacitor 1101 (see FIG. 11). If the insulated mesh of a contact zone is close enough to the conductive mesh of the contacting instrument (e.g., approximately one inch) for long enough (e.g., approximately 1/10 second), then capacitive coupling and detection of the tone will occur. The external coverings 1008 and 1011 protect and assist in the electrical isolation of the conductive mesh 1007, 1010.

In the helmet embodiment, there is significant padding 1006, which acts as a backing to the conductive mesh. In the vest and groin cover embodiments, the amount of padding 109 behind the conductive mesh may be thinner in some cases.

The protective goggles 1012 contain a very fine conductive mesh 1005 inside the plastic lenses 1006 which is electrically connected to the conductive mesh 1007 of the head gear 1001. The functions of these goggles 1012 include eye protection and impulse detection via the conductive mesh 1005.

FIG. 11 illustrates details of the electrical coupling of the tone 1107 produced by the tone generator 1103 into the tone detector circuit 1104 as tone 1106.

In this embodiment, to couple tones: (1) an impulse must be received that causes the tone-generator circuit 1103 to generate a tone 1107 of the aggressing combatant (e.g., the glove of combatant 101); (2) the tone 1107 must be transmitted to mesh 1102; (3) the distance "D" 1112 between the generating conductive mesh 1102 and the receiving conductive mesh 1101 must be sufficiently proximate, e.g., less then ½ inch, to conductive mesh 1101 to cause capacitive transfer; (4) the position of the conductive mesh 1102 over the conductive mesh 1101 must sufficiently overlap, e.g., overlap approximately 1 to 2 square inches, to cause capacitive transfer; (5) the proximity and overlapping must remain for a sufficient duration, e.g., at least 1/20–1/10 of a second, that the two conductive meshes can cause capacitive transfer; (6) capacitive transfer, as represented by field lines 1111, transfers to mesh 1101; and (7) the tone 1106 must transfer to tone detector circuits 1104.

Figure 12:
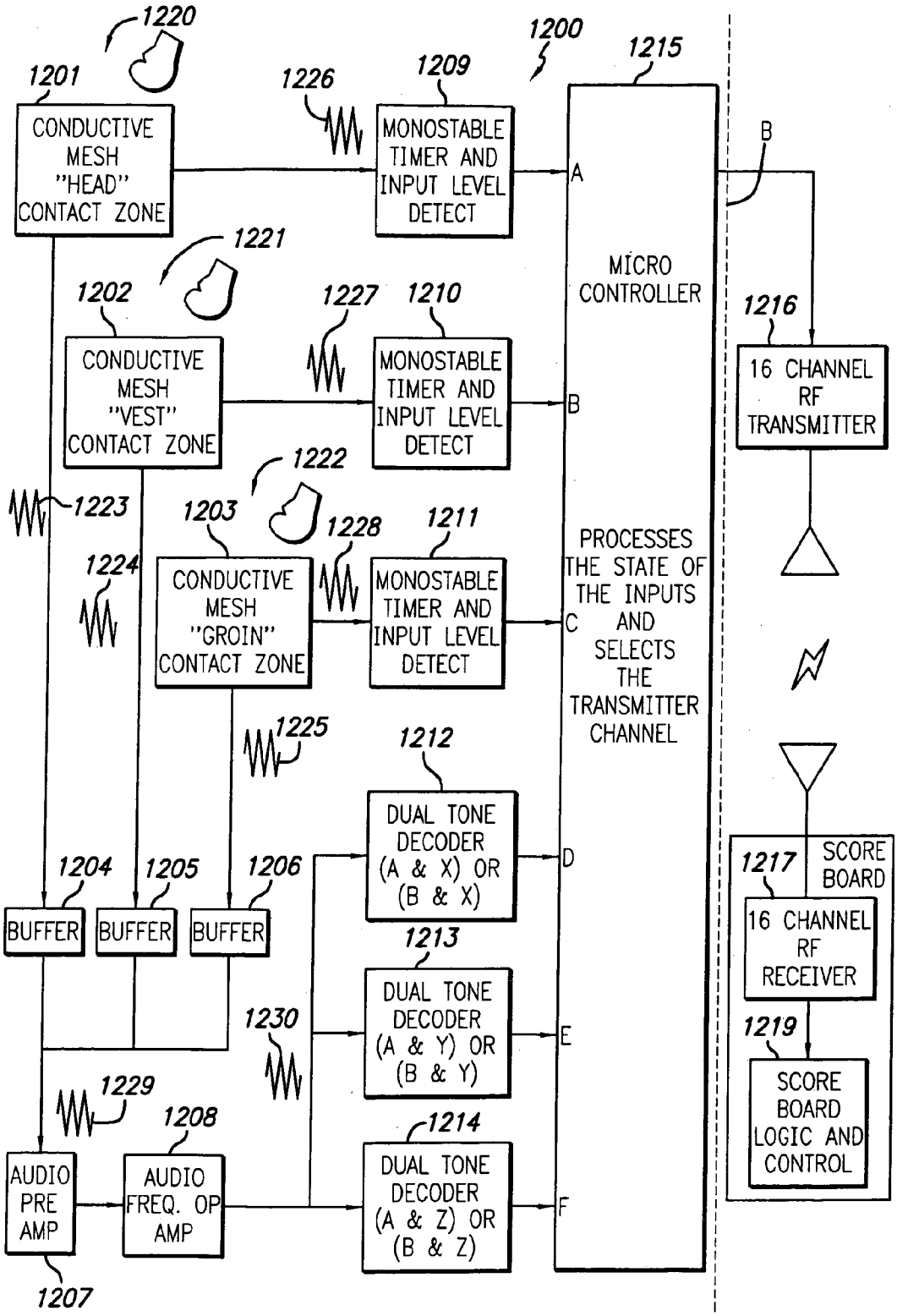
FIG. 12 is a block diagram illustrating the tone-detecting circuit and transmitter-selection circuit.

The capacitive field 1111 will fluctuate at the frequency of the tone 1107 generated by the tone generator circuit 1103. This fluctuation will induce a fluctuating potential on the conductive mesh 1101 of the contact zone of the opponent. This fluctuating potential on the conductive mesh 1101 is fed into an op-amplifier in the tone detection circuit 1104, which performs the role of voltage to current transduction as shown in FIG. 12. The resulting frequency is equal to that of the tone 1107.

Capacitive coupling is the simplest format, requiring no return signal path to circuit ground and thus no current flowing in the conductive mesh 1102. In contrast, the inductive coupling method, represented by the inductive field lines 1108, requires the return signal path to circuit ground 1113. This return path generates a current 1109 to flow in the conductive mesh creating the inductive field 1108 in the individual conductors. This will induce an opposite current in the conductive mesh 1101 of the contact zone fluctuating at the same rate of the tone 1107. This method has also been tested to work properly.

Physical electrical contact is another tested alternative embodiment. However, this format has a few drawbacks resulting form the signal being lost due to accidental contact by one of the combatant's hands. In addition, when the wearer perspires and makes contact with the conductive mesh, a path to ground is created decreasing the capacitive field.

FIG. 12 is a diagram illustrating a tone-detecting circuit 1200, the associated RF transmitter 1216, and the scoreboard receiver 1217. The contacting instruments 1220, 1221, and 1222 are shown to add clarity. A tone-detecting sequence begins by a forceful blow of sufficient force on the surface of the one of the contact zones to trigger the tone-generating circuit 1200 of the contacting instrument 1220, 1221, and 1222. If this occurs, tones from the contacting instrument 1220, 1221, 1222 will capacitively couple to the conductive mesh 1201, 1202, 1203 of the contact zone. If the coupling occurs in the "head" mesh 1201, then the tone 1226 and tone 1223, which may be identical, are presented to the inputs of two electronic circuits, namely, to a mono-stable timer 1209 and to an input buffer chip 1204. Similarly, if the coupling occurs in the "vest" mesh 1202, then the tone 1227 and tone 1224, which may be identical, are presented to the inputs of two electronic circuits, namely, to a mono-stable timer 1210 and to an input buffer chip 1205. And again, if the coupling occurs in the "groin" mesh 1203, then the tone 1228 and tone 1225, which may be identical, are presented to the inputs of two electronic circuits, namely, to a monostable timer 1211 and to an input buffer chip 1206.

The monostable timer and input level detect circuits 1209, 1210, 1211 are triggered if a signal of sufficient amplitude is presented to their inputs. The frequency of the signal is essentially unimportant. The output of these circuits 1209, 1210, 1211 toggle for a very short duration (approx. ¼ of a second) for a sufficiently high input trigger. The outputs of each timer are presented to the microcontroller 1215 inputs. Thus, a signal of sufficient amplitude in the mesh 1201 (head), mesh 1202 (vest), or mesh 1203 (groin) will result in the microcontroller 1215 inputs A, B, or C respectively being toggled for a short time period. How the microcontroller utilizes this information will be discussed in the discussion of FIGS. 12 and 13. The buffers 1204, 1205, 1206 may include unity-gain operational amplifiers used as high impedance input buffers. These circuits will pass the signal to an audio pre-amp 1207 and to an audio frequency operational amplifier 1208 to amplify the signal, in this embodiment, two to four times. The output of amplifier 1208 is substantially simultaneously presented to three dual tone decoders 1212, 1213, and 1214. These tone decoders 1212, 1213, 1214 provide "force of the blow" information to the microcontroller 1215. Decoder 1212 activation equates to soft blow, decoder 1213 activation equates to medium blow, and decoder 1214 activation equates to a hard blow.

The outputs of these tone decoders will only toggle if the input signal 1230 matches exactly the pair of frequencies the circuit is tuned to receive. The dual tone decoder 1212 is tuned to detect only frequencies A and X if it is part of combatant 102 uniform and B and X if it is part of combatant 101 uniform. Similarly the dual tone decoder 1213 is tuned to detect only frequency A and Y if it is part of combatant 102 uniform and B and Y if it is part of combatant 101 uniform. And again, the dual tone decoder 1214 is tuned to detect only frequency A and Z if it is part of combatant 102 uniform and B and Z if it is part of combatant 101 uniform. The outputs of each dual tone decoder will be presented to the microcontroller 1215. Thus, when a signal of exactly the correct two frequencies the dual tone decoders 1212 (soft hit), 1213 (medium hit), or 1214 (hard hit) are tuned to detect, the microcontroller 1215 inputs D, E, or F, respectively, are toggled for a short time period. Absence of an "A" tone will indicate an improper hit, possibly from the combatant's own contacting instrument. Description of the microcontroller 1215 operations is discussed in the description with reference to FIG. 13. In this embodiment, the microprocessor 1215 monitors the outputs of the timer circuits 1209, 1210, 1211 and of the decoders 1212, 1213, and 1214 one thousand times a second or on a 1 millisecond loop. For this microprocessor 1215 to turn on the transmitter 1216, two conditions must be satisfied. The first condition is that only one tone decoder output is toggled for 10 passes. The second condition is that, coinciding with the tone decoder, one or more of the contact zones timers 1209, 1210, 1211 are toggled. If these conditions are satisfied, the microprocessor selects an RF channel as per FIG. 13 and turns on the transmitter 1216 for, for example, 100 milliseconds.

Figure 15:
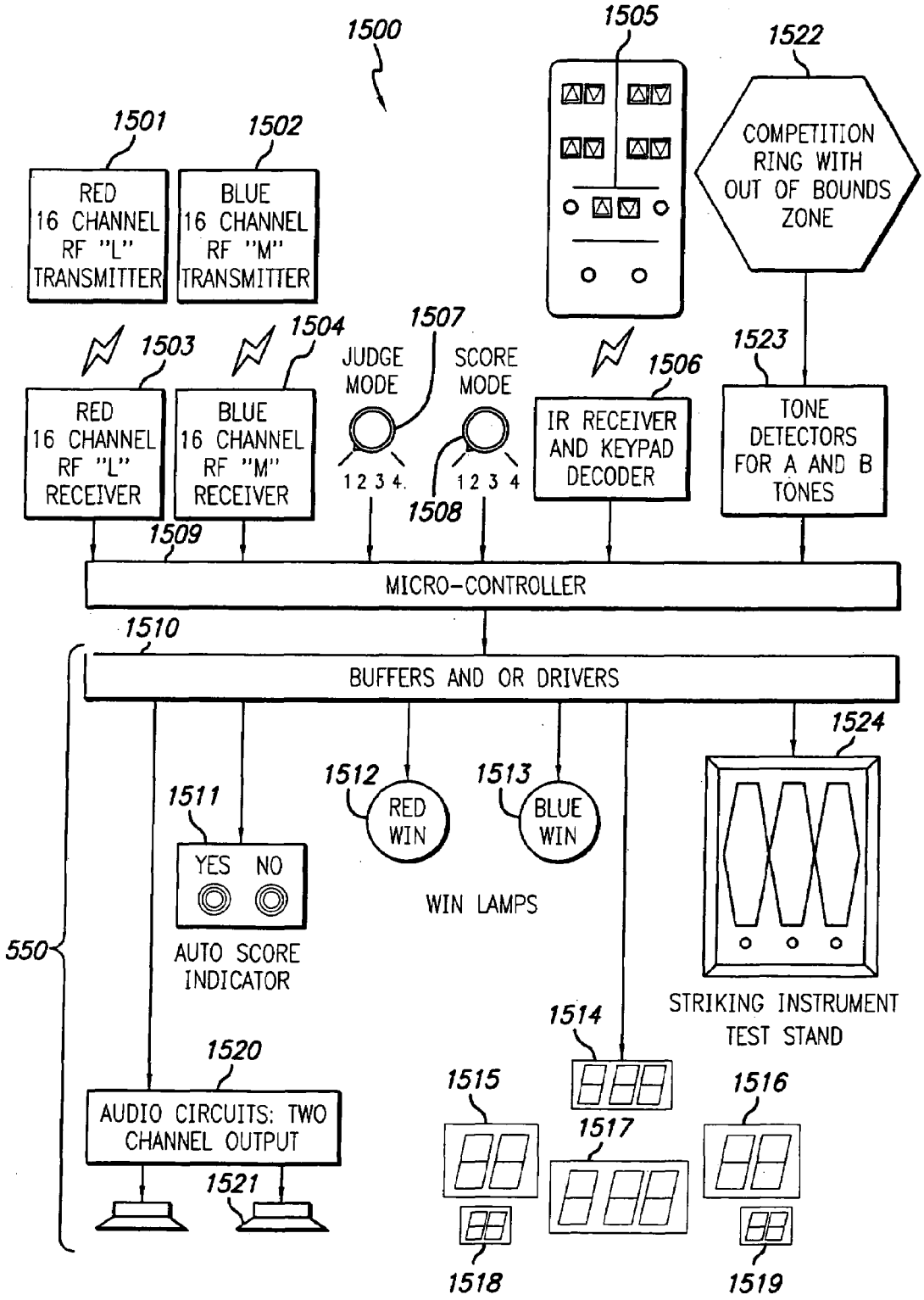
FIG. 15 is a block diagram illustrating example scoreboard circuitry.

The coded RF signal is transmitted to the scoreboard 1217, where a receiver 1218 receives the signal and decodes the RF channel information to be presented to the scoreboard logic and control 1219 for processing. FIG. 15 depicts the scoreboard logic details. FIG. 13 depicts a table showing example Combatant 101 RF channel assignments enabling selection of RF channels for the transmitter 1216 to transmit to the scoreboard receiver 1218. The transmitter 1216 and receiver 1218 will be discussed in detail in FIG. 15. For instance, if the head of combatant 102 is hit with medium force by a combatant 101 contacting instrument, then lines A (combatant 101 striking a contact zone of combatant 102) and E (combatant 102 being contacted with medium force) would be toggled at the microcontroller 1215 for a short time. As shown, tones A and X are produced by soft impulse switch activation, tones A and Y are produced by medium impulse switch activation, and tones A and Z are produced by hard impulse switch activation. Although not shown, one skilled in the art will recognize that, for combatant 102, tone A would be replaced by tone B. In other embodiments, additional RF channels may be used to identify the contacting instrument (e.g., right hand glove, left hand glove, left boot, right boot). The notes on the table contain additional information concerning the usability of the table.

Figure 14A:
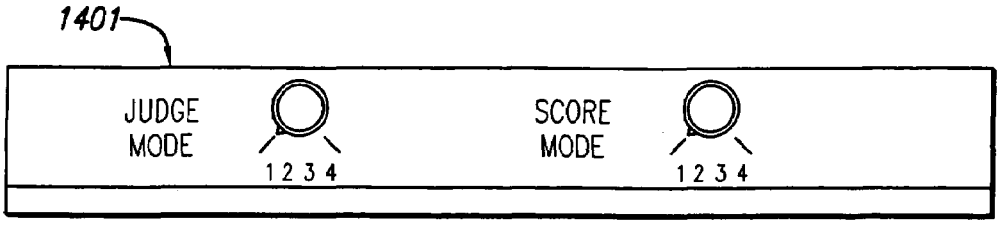
FIGS. 14*a–c* illustrate an example scoreboard and infrared scoreboard controller.
Figure 14B:
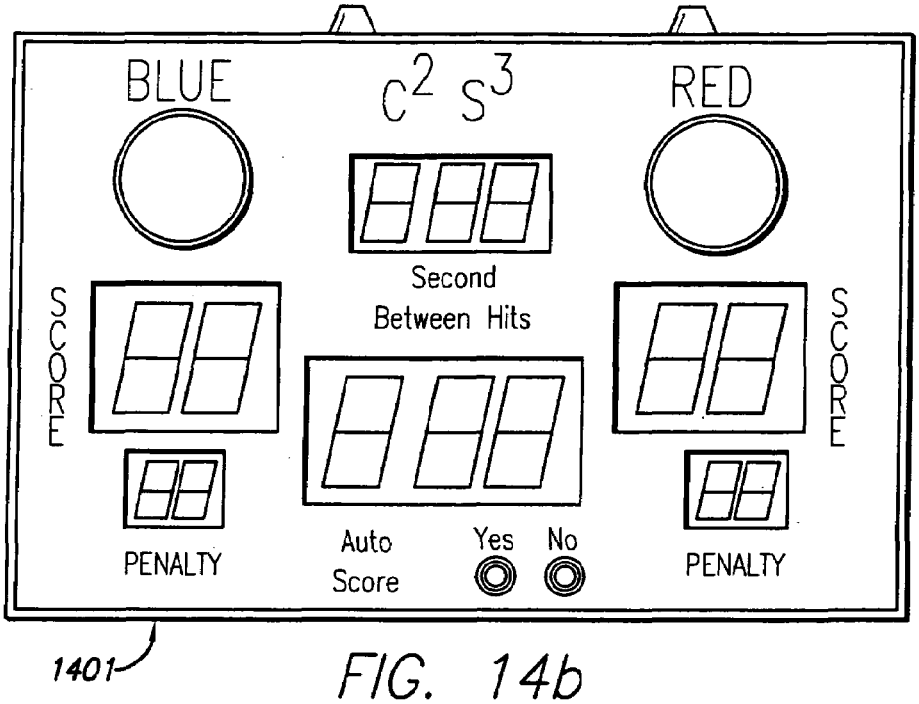
Figure 14C:
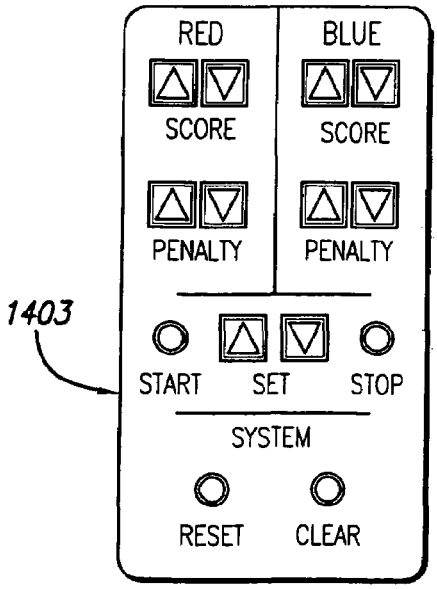

FIG. 14*a* illustrates a side view of an example scoreboard 1401. FIG. 14*b* illustrates a front view of scoreboard 1401. FIG. 14*c* illustrates a hand-held infrared controller 1403 for use by the judges to control the scoreboard. The scoreboard 1401 could easily be compacted into a small brief case size for martial art schools. This could be shrunk even further to a hand held battery operated size for personal or home use or for use in a toy. The main purpose of FIGS. 14*a*, 14*b*, and 14*c* is to assist in the understanding of FIG. 15 that provides a description of the scoreboard circuitry.

FIG. 15 illustrates possible configuration of the scoreboard 1550 and controller circuitry 1500. Although the diagram is for an electromechanical scoreboard 1550, the circuitry 1500 could easily be embodied into a hand-held device containing an alphanumeric display and a touch pad for use input and control. The transmitters 1501 and 1502 operate at a different RF frequency. For this description frequency "L" will be used for transmitter/receiver 1501/1503 (combatant 102, RED) and frequency "M" will be used for transmitter/receiver 1502/1504 (combatant 101, BLUE). When a valid hit is detected, the transmitters 1501 or 1502 transmit any 1 of 16 pulse trains as per FIG. 13 to their respective receivers 1503 or 1504. The matched RF receivers 1503 and 1504 receive the transmitted signal and present the decoded channel information to the scoreboard microcontroller 1509. The frequencies L and M may be transmitted and received substantially simultaneously, since they may use unique carrier frequencies in either the 300 MHz or 900 MHz bands.

Depending upon the switch settings of the "Judge Mode" 1507 and the "Score Mode" 1508, the software in the scoreboard 1550 will respond differently. The score mode 1508 will allow the system to operate in either auto-score mode with no judge intervention or manual score where a judge would manually advance the score. This switch could also provide the capability to select some combination of the two modes. The state of the score mode is displayed via the indicator 1511. The judge mode 1507 works in conjunction with FIG. 13 and determines how different combinations "force of contact" and "zones of contact" are to be scored. For example, a head blow of medium force would result in two points awarded to the aggressor whereas a head blow of hard force would be judged as a penalty for the aggressor.

The hand-held infrared controller 1505 and decoder 1506 allow for user control of the software/hardware of the scoreboard 1550. The competition mat 1522 and tone decoder circuit 1523 are described in FIGS. 16 and 17. They are used to determine if a player is out of bounds, and can be used to inform the software that a player has one or both feet off the ground. This information can be used in conjunction with the judge mode 1507 to determine how a particular aggressive contact would be scored. For instance if a combatant has both feet off the ground at the same instance that a combatant delivers an aggressive blow to his opponent, he could receive double point.

The scoreboard 1550 indicates the state of the competition to the players and the spectators via an assortment of displays of sounds and lights. The output is buffered from the microcontroller, if needed, via the buffer and driver circuits 1510. The winner lamp 1512 and 1513 is turned off and on to reflect wins. In this embodiment, if both players hit each other in a near simultaneous event, the first to hit will have his light on flashing and the other will have his light on steady. The display 1514 could display the time between the clash with in 1/100 of a second. Display 1515/1516 can display score. Display 1518/1519 can display penalties. Display 1517 can display countdown time indicating how much time is remaining in the match. An audio sound is generated for selected events in the sequence of a match such as start of match, end of match, and when each combatant is struck. The sound circuit 1520 utilizes some digital audio technology provided for two channels so if both players clash both sounds are heard simultaneously via the speakers 1521.

It will be appreciated that microcontroller 1509 and/or buffers/drivers 1510 can be a part of a computer system, configured in accordance with a software program. The software program can include simple analysis of the incoming signals to determine proper response and scoreboard display. One skilled in the art knows that a computer system includes RAM, ROM, permanent storage, at least one processor, communications interfaces, internet connections, etc.

The striking instrument test stand 1524 is described in detail with reference to FIGS. 18 and 19. The microcontroller 1509 will update the test stand 1524 if the score mode is in test mode.

Figure 16:
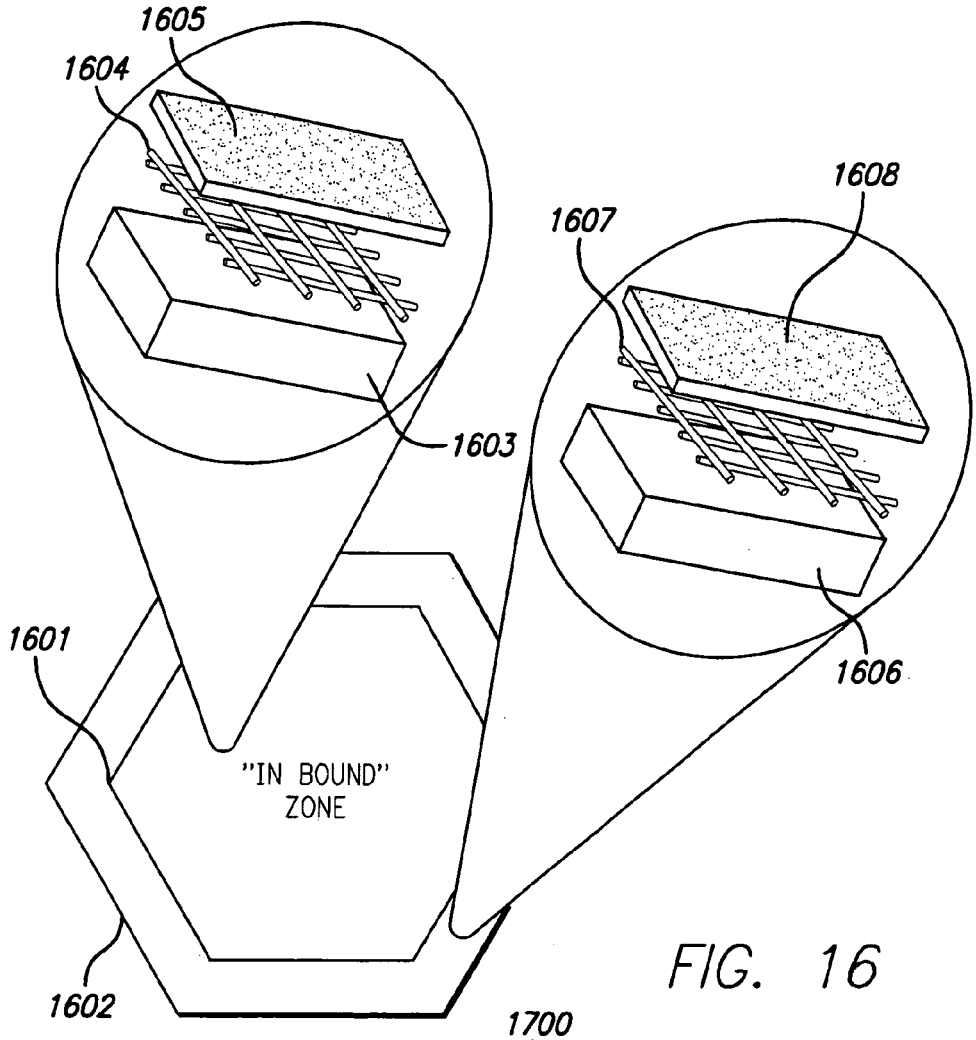
FIG. 16 illustrates details of a tone-detecting competition mat.

FIG. 16 depicts a detailed view of a martial arts competition mat. The "In-Bounds" zone 1601 and the "Out-of-Bounds" zone 1602 are constructed similar to that of the padded protective gear of the contact zones of the opponent's uniform. The padded mat is constructed in three layers. The bottom layer 1603 and 1606 is a thick padded foam similar to that inside of mats in use today in martial arts schools. The insulated conductive meshes 1604 and 1607 are electrically connected to a tone-detection circuit and, together, are used to detect the presence of the tone produced by the tone generator 210 (FIG. 2) & 1701 (FIG. 17) located in combatants' boots. The outer layers 1605 and 1608 are protective layers used to protect the electric mesh from damage and to add additional insulation.

Figure 17:
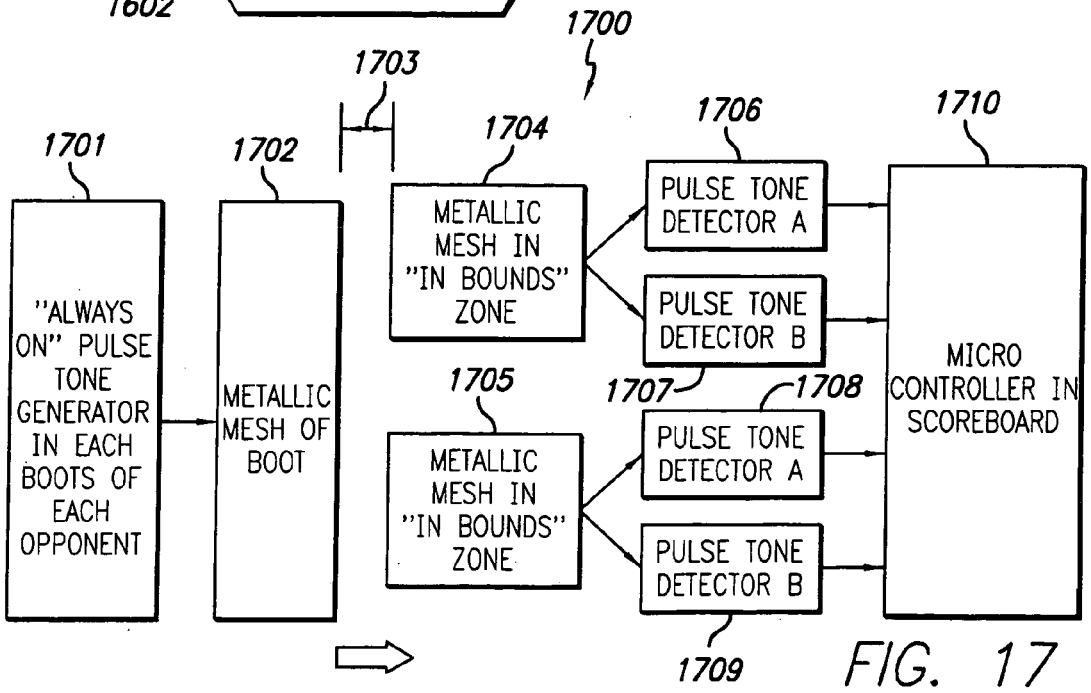
FIG. 17 is a block diagram illustrating tone-detecting mat circuitry.

FIG. 17 depicts the mat tone detection circuitry 1700. Each boot of each combatant contains a pulsed tone generator 1701 connected to a metallic mesh 1702, which may be the same one used for coupling the tone generation circuit with tone detection circuit of the opponent's uniform. The pulsed tone generator 1701 is an "always on" circuit. Electrical coupling should occur as long as the metallic mesh 1702 of the boot is within a limited distance 1703 (less then 1 inch) of the metallic mesh 1704 of the "In-Bounds" zone or the metallic mesh 1705 of the "Out-of-Bounds" zone. As long as a pulsed tone is present on at least one of the metallic meshes 1704 or 1705, detection should occur in one of the pulse tone detectors 1706, 1707, 1708, or 1709. The presence or absence of each combatant's pulsed tone at the tone detectors 1706-1709 is presented to the scoreboard microcontroller 1710. The microcontroller 1710 utilizes this information to signal that an opponent has stepped out of bounds or possibly to indicate that the aggressor was airborne when a blow was delivered. The pulsed tone generator can be constructed utilizing a variety of commercially available integrated circuits. An example of one such circuit utilizes two LM555 timers configured such that the first timer turns on the second timer for very short pulses. The second timer is configured as a simple square wave generator.

Figure 18:
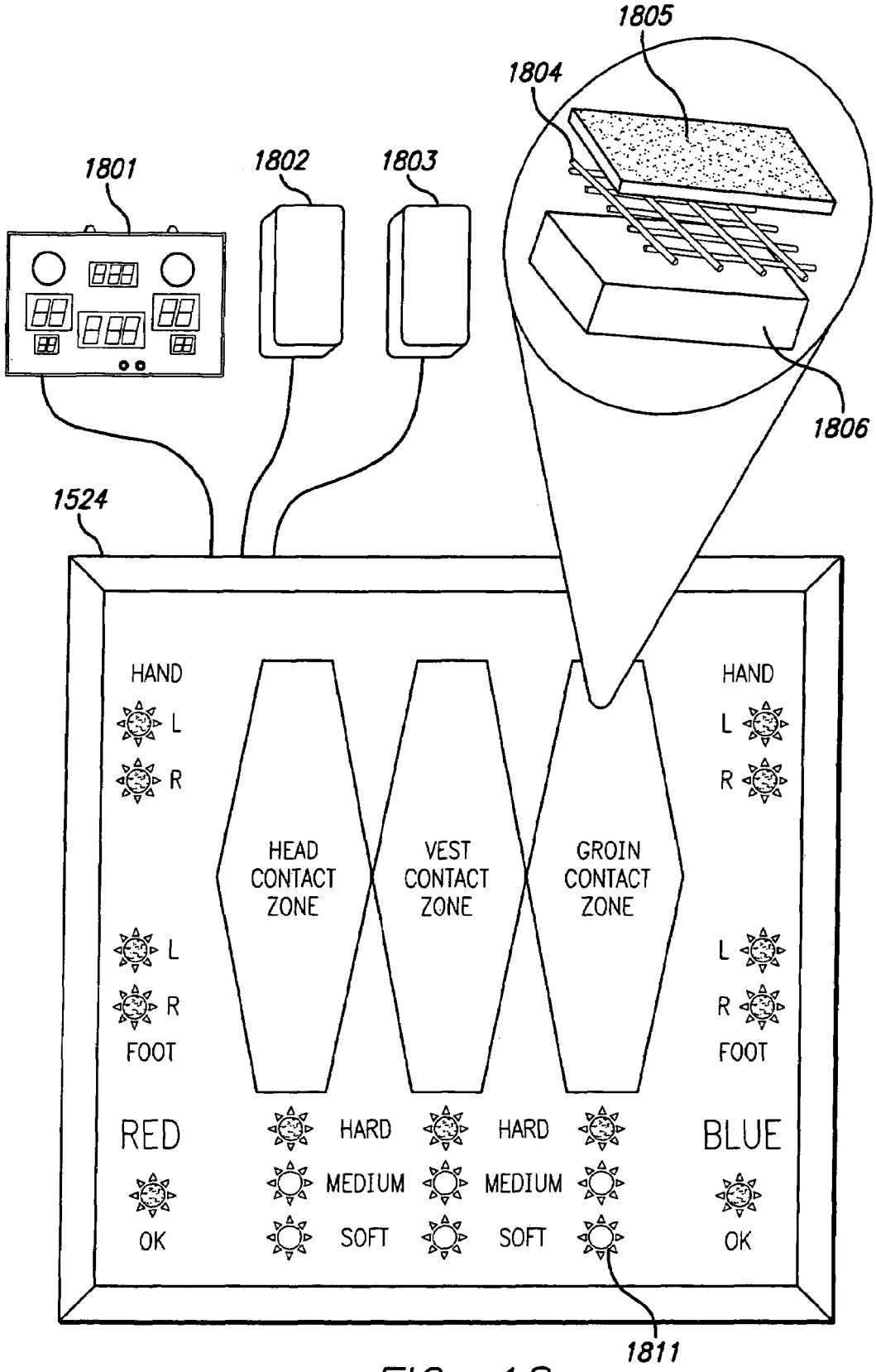
FIG. 18 illustrates a striking instrument test stand.

FIG. 18 illustrates one possible striking instrument test stand 1524. In this configuration, the test stand 1524 is electrically connected to the scoreboard 1801, and to opponents' tone detectors 1802 and 1803. The contact zones 1808, 1809, and 1810 are very similar to the padded contact zones of the opponents protective helmet 1001 shown in FIG. 10 or to the competition mats 1601 shown in FIG. 16. The construction of the contacts zone would incorporate a metallic mesh 1805 sandwiched between an outer covering 1804 and a padded substrate 1806. The theory of operation is the same as of other contact zones, where a tone generated in the striking instrument is coupled. When the scoreboard 1801 is placed in test mode, the lights 1811 of the test stand 1524 would indicate which contact zone an opponent should strike, with which striking instrument and with how much force. For instance if the computer was prompting opponent 101 to strike his left foot onto the vest contact zone with a medium force blow, the following light would flash: Blue FOOT "L" and the center lamp (Medium) under the "Vest Contact Zone". Upon successful administration of a blow, the flashing lamps would turn solid and the next set of lamps would flash. If the opponent strikes a contact zone that is not identified as "Active", for instance, in the above example, the head, that contact would be ignored by the test stand 1524.

A variation of the striking instrument apparatus could be embodied in a child's toy. This toy would allow players to compete against each other by attempting to be the first to identify and hit active contact zones on stands or floor mats with some implementation of a striking instrument. The active contact zones could be identified via a visual identifier such as a flashing light on the active contact zone. The system would uniquely detect each player striking instruments. The system could be set up to keep score and determine a winner or just make different sounds for the first player to hit the active floor area. This system could also be used for a single player play where a player would compete against the clock to achieve as many strikes as possible before time runs out.

Figure 19:
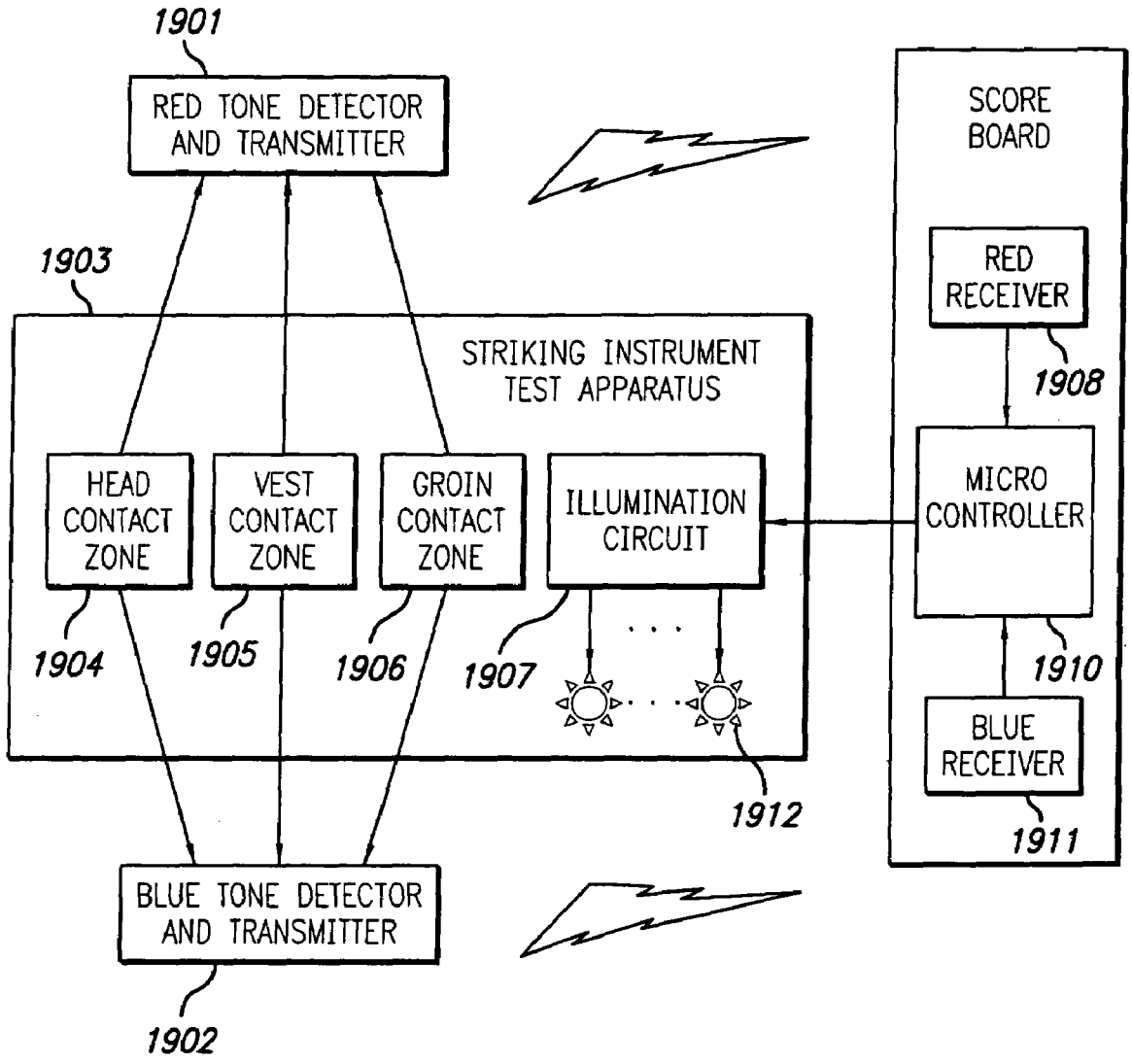
FIG. 19 is a block diagram of the striking instrument test stand.

FIG. 19 is a block diagram illustrating another striking instrument test stand 1524. The apparatus 1903 includes illumination circuit 1907 used to turn on and off the indicator lamps 1912. The test apparatus 1903 is electrically connected to the scoreboard microcontroller 1910. The scoreboard microcontroller 1910 controls the lamps on the test apparatus 1524. When an opponent strikes one of the contact zones 1904, 1905, or 1906 with their striking instrument (not shown) with sufficient force, one of the tone generator circuits (not shown) in the striking instruments turns on for a short duration. This tone will couple to both of the tone detector/transmitters circuits 1901 or 1092, substantially simultaneously. Either detector 1901 or detector 1902 will detect the tone and transmit a coded signal to the scoreboard receivers 1908 or 1911. The coded signal will be decoded and presented to the microcontroller 1910 (e.g., software). If the decoded signal corresponds with what the microcontroller is expecting, the lights 1912 will be altered accordingly. For example, if the current state of the test apparatus lights 1912 are Blue Foot left "L" is flashing and center light, medium, under the vest contact zone is flashing. This would be prompting the Blue opponent to strike the Vest contact zone with a medium blow. If the opponent 101 delivers the prescribed blow, the flashing lights 1912 stop flashing and the next set of lamps 1912 would begin to flash. This would continue until all the striking instrument and contact zone combinations have been tested.

The foregoing description of the embodiments is by way of example only, and other variations and modifications of the above-described embodiments and methods are possible in light of the foregoing teaching. For example, components of this invention may be implemented using a programmed general purpose digital computer, using application specific integrated circuits, or using a network of interconnected conventional components and circuits. Connections may be wired, wireless, modem, etc. The embodiments described herein are not intended to be exhaustive or limiting. The present invention is limited only by the following claims.

What is claimed is:

1. A proximity contacting instrument, comprising:

a substrate;

a first conductive mesh coupled to the substrate;

a first switch coupled to the substrate, the first switch having a first state and a second state, the first switch for switching from the first state to the second state and a first tone generator coupled to the first switch and to the first conductive mesh for generating a first tone on the first conductive mesh when the first switch switches to the second state.

2. The proximity contacting instrument of claim 1, wherein the instrument includes a body covering, a weapon, a toy, a wand, a pointer, or a projectile.

3. The proximity contacting instrument of claim 1, wherein the substrate is padded.

4. The proximity contacting instrument of claim 1, wherein the substrate is rigid.

5. The proximity contacting instrument of claim 1, wherein the substrate is flexible.

6. The proximity contacting instrument of claim 1, wherein the substrate includes foam.

7. The proximity contacting instrument of claim 1, wherein the conductive mesh is insulated.

8. The proximity contacting instrument of claim 1, wherein the conductive mesh acts as one of the plates of a capacitor.

9. The proximity contacting instrument of claim 1, wherein the conductive mesh acts as a flux-producing element for mutual inductance.

10. The proximity contacting instrument of claim 1, wherein the conductive mesh acts as a simple conductor.

11. The proximity contacting instrument of claim 1, wherein the first switch includes a piezoelectric film transducer.

12. The proximity contacting instrument of claim 1, wherein the first switch includes a strain gage switch.

13. The proximity contacting instrument of claim 1, wherein the first switch includes a impulse switch.

14. The proximity contacting instrument of claim 1, wherein the first switch includes a mechanical off/on switch.

15. The proximity contacting instrument of claim 1, wherein the first switch includes a magnetic switch.

16. The proximity contacting instrument of claim 1, wherein the first switch includes a electronic circuit capable of switching between the first state and the second state in a predetermined or random pattern.

17. The proximity contacting instrument of claim 1, further comprising a second switch coupled to the first conductive mesh and to a second tone generator, the second tone generator being capable of generating a second tone that is different than the first tone.

18. The contacting instrument of claim 1, wherein the tone generator is battery powered.

19. A method, comprising:

using a switch in a proximity contacting instrument to detect when the instrument is in proximity of a detecting instrument, the switch having an active state and an inactive state; and generating at least one tone when the switch is in the active state.

20. The method of claim 19, wherein the switch includes an impulse switch.

21. The method of claim 20, wherein the at least one tone includes a first tone indicating a source.

22. The method of claim 19, wherein the at least one tone is generated applied onto a conductive mesh.

23. A proximity contact detecting instrument, comprising:

a substrate;

a first conductive mesh coupled to the substrate for receiving at least one tone via capacitive coupling with a conductive mesh of a second instrument; and a first tone decoder coupled to the conductive mesh for determining whether the at least one tone is a member to a first predetermined set of at least one tone.

24. The proximity-detecting instrument of claim 23, wherein the second instrument includes a body covering or a mat.

25. The proximity-detecting instrument of claim 23, wherein the substrate includes padding.

26. The proximity-detecting instrument of claim 23, wherein the substrate includes foam.

27. The proximity-detecting instrument of claim 23, wherein the conductive mesh acts as one plate of a capacitor.

28. The proximity-detecting instrument of claim 23, further comprising a second tone decoder coupled to the conductive mesh for determining whether the at least one tone is member to a second predetermined set of at least one tone.

29. The proximity-detecting instrument of claim 28, wherein the second predetermined set is different from the first predetermined set.

30. The proximity-detecting instrument of claim 23, further comprising a second conductive mesh coupled to the substrate and to the tone decoder.

31. A method, comprising:

detecting at least one tone when a proximity detecting instrument is in proximity of a proximity contacting instrument;

determining whether the at least one tone is member to a predetermined set of tones; and generating a signal if the at least one tone is member to the predetermined set of tones.

32. The method of claim 31, wherein the at least one tone includes a first tone indicating source.

33. The method of claim 31, wherein the predetermined set of at least one tone includes a first tone indicating source.

34. The method of claim 31, wherein the at least one tone is detected by a conductive mesh.

35. The method of claim 31, wherein the at least one tone is detected through capacitive coupling.

36. The method of claim 31, wherein the at least one tone is detected through inductive coupling.

37. The method of claim 31, wherein the at least one tone is detected through physical coupling.

38. The method of claim 31, wherein the at least one tone is detected through electrical coupling.

* * * * *